US007975495B2

(12) United States Patent
Voorhis et al.

(10) Patent No.: US 7,975,495 B2
(45) Date of Patent: Jul. 12, 2011

(54) CONTROL SCHEME FOR COORDINATING VARIABLE CAPACITY COMPONENTS OF A REFRIGERANT SYSTEM

(75) Inventors: Roger J. Voorhis, Clarksville, TN (US); Patrick B. Sowada, Clarksville, TN (US)

(73) Assignee: Trane International Inc., Piscataway, NJ (US)

( * ) Notice: Subject to any disclaimer, the term of this patent is extended or adjusted under 35 U.S.C. 154(b) by 446 days.

(21) Appl. No.: 12/291,124

(22) Filed: Nov. 6, 2008

(65) Prior Publication Data

US 2010/0107668 A1 May 6, 2010

(51) Int. Cl.
*F25B 49/00* (2006.01)
*F25D 17/00* (2006.01)

(52) U.S. Cl. ..... 62/176.6; 62/179; 62/181; 62/183; 62/228.1

(58) Field of Classification Search ..... 62/228.1, 62/228.4, 179, 180, 181, 182, 183, 176.1, 62/176.6

See application file for complete search history.

(56) References Cited

U.S. PATENT DOCUMENTS

| | | | | |
|---|---|---|---|---|
| 4,590,772 | A | 5/1986 | Nose et al. | |
| 5,062,276 | A | 11/1991 | Dudley | |
| 5,303,561 | A | 4/1994 | Bahel et al. | |
| 5,305,822 | A | 4/1994 | Kogetsu et al. | |
| 5,345,776 | A | 9/1994 | Komazaki et al. | |
| 5,426,951 | A | 6/1995 | Yamashita et al. | |
| 6,223,543 | B1 | 5/2001 | Sandelman | |
| 6,826,921 | B1 | 12/2004 | Uselton | |
| 2006/0112702 | A1 * | 6/2006 | Martin et al. | 62/180 |

* cited by examiner

*Primary Examiner* — Marc Norman
(74) *Attorney, Agent, or Firm* — William O'Driscoll

(57) ABSTRACT

A refrigerant system adjusts, in a coordinated prioritized manner, the variable capacities of a compressor, evaporator fan and a condenser fan to minimize the system's overall power consumption while maintaining a comfort zone within a target comfort range. The target comfort range is defined by desired temperature and humidity limits. When the comfort zone is within the target comfort range, the system periodically attempts to reduce the compressor capacity. If the attempt succeeds, the evaporator fan capacity is then minimized. The condenser fan capacity can also be minimized provided the refrigerant system can maintain at least a minimum saturated suction temperature of the refrigerant flowing from the condenser to the compressor.

23 Claims, 3 Drawing Sheets

CONTROL SCHEME FOR COORDINATING VARIABLE CAPACITY COMPONENTS OF A REFRIGERANT SYSTEM

FIELD OF THE INVENTION

The subject invention generally pertains to refrigerant systems and more specifically to a control scheme for adjusting and coordinating the variable capacities of certain system components.

BACKGROUND OF RELATED ART

To meet the varying cooling and/or dehumidifying load of a comfort zone, some HVAC refrigerant systems might include a system component of adjustable capacity. Examples of adjustable capacity components include compressors, indoor evaporator fans and outdoor condenser fans.

U.S. Pat. No. 5,303,561 discloses adjusting the indoor fan speed to meet the latent cooling needs of a comfort zone. U.S. Pat. No. 4,590,772 suggests varying the draft volume to a condenser based on the refrigerant pressure therein. U.S. Pat. No. 5,062,276 discloses a refrigerant system where the fan speed is varied linearly with compressor speed, and their speed relationship is altered in response to the need for dehumidification. U.S. Pat. Nos. 5,305,822; 5,345,776; 5,426,951 and 6,826,921 disclose varying the speed of an outdoor fan. And U.S. Pat. No. 6,223,543 discloses varying the speed of an indoor fan.

Although adjusting the capacity of a single component might be relatively straightforward, it can be challenging to control a refrigerant system that includes more than one component of adjustable capacity because varying the capacity of one component can affect the performance of another.

Consequently, there is a need for a refrigerant system that provides a method of adjusting and coordinating the variable capacities of multiple, interrelated components of the system.

SUMMARY OF THE INVENTION

It is an object of the invention to provide a refrigerant system that can adjust in a coordinated manner the variable capacities of a compressor system, an evaporator fan system and a condenser fan system.

Another object of some embodiments is to provide a control scheme that minimizes the power consumption of a refrigerant system that includes multiple variable capacity components.

Another object of some embodiments is to minimize the capacity of a refrigerant system in a prioritized order with the compressor system being first, the evaporator fan system being second, and the condenser fan system being third.

Another object of some embodiments is to minimize the capacity of a compressor system by periodically attempting to reduce the compressor capacity in a trial-and-error method.

Another object of some embodiments is to minimize the power consumption of a refrigerant system while maintaining a comfort zone within a target comfort range and maintaining at least a minimum saturated suction temperature of refrigerant leaving the system's condenser.

One or more of these and/or other objects of the invention are provided by a refrigerant system that periodically attempts to reduce the compressor capacity when the comfort zone is within a target comfort range. If the attempt succeeds, the evaporator fan capacity is then minimized. The condenser fan capacity can also be minimized provided the refrigerant system can maintain at least a minimum saturated suction temperature of the refrigerant flowing from the condenser to the compressor.

DESCRIPTION OF THE PREFERRED EMBODIMENT

Figure 1:
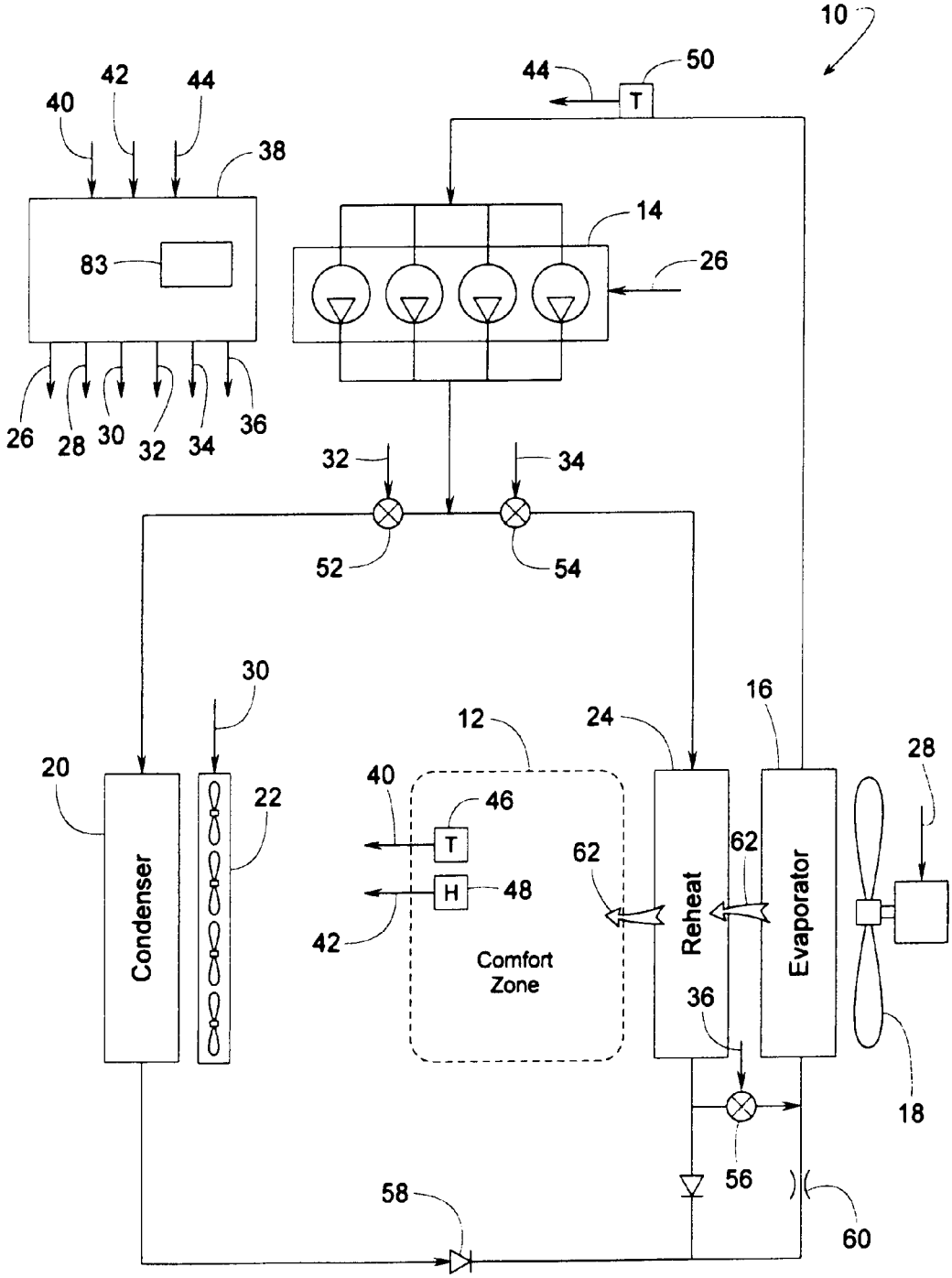
FIG. 1 is a schematic diagram of a refrigerant system.

FIG. 1 schematically illustrates a refrigerant cooling system 10 for controlling the temperature and humidity of a comfort zone 12, such a room or area of a building. To meet the comfort zone's varying demand for cooling or dehumidification, system 10 includes a compressor system 14 with variable compressor capacity (in terms of refrigerant mass flow rate), an evaporator 16 associated with an evaporator fan system 18 with variable evaporator fan capacity (in terms of standard airflow volume across evaporator 16), a condenser 20 associated with a condenser fan system 22 with variable condenser fan capacity (in terms of standard airflow volume across condenser 20), and an optional reheat coil 24 that can be used for heating the cooled air exiting evaporator 16 when system 10 is needed for dehumidifying without sensible cooling.

It is well known to those of ordinary skill in the art that there are countless ways of varying the operating capacities of individual compressor and fan systems. Some ways include, but are not limited to, variable speed drive for a fan or compressor, variable position slide valve for a screw compressor, variable inlet guide vanes for a centrifugal compressor, multiple compressors or fans that are individually energized in stages, etc. For sake of example, the present invention will be described as compressor system 14 comprising four equivalent compressors that are selectively energized to provide variable compressor capacity, evaporator fan system 18 comprising a single blower driven at varying speed to provide variable evaporator fan capacity, and condenser fan system 22 comprising four equivalent fans that are individually energized to provide variable condenser fan capacity.

Compressor system 14, condenser fan system 22, evaporator fan system 18, and other operating components of system 10 are controlled by output signals 26, 28, 30, 32, 34 and 36 from a controller 38 in response to feedback signals 40, 42 and 44 from various sensors. For the illustrated embodiment, for example, signal 40 is an indoor air temperature signal from a temperature sensor 46 that senses the dry bulb temperature of the indoor air of comfort zone 12, signal 42 is a humidity signal from a humidity sensor 48 that senses a humidity characteristic of zone 12 (e.g., relative humidity, or specific humidity), and signal 44 is a suction refrigerant signal from a suction refrigerant sensor 50 that senses a temp/press value of the refrigerant flowing to compressor system 14. The term "temp/press value" as used throughout this patent means a temperature or pressure value, thus a temp/press value of a refrigerant means the temperature or pressure of the refrigerant. Examples of a "temp/press value" include, but are not limited to, the saturation temperature and/or pressure of the refrigerant leaving evaporator 16 or entering compressor system 14.

For the illustrated embodiment, output signal 26 controls the compressor capacity; signal 28 controls the evaporator fan capacity; signal 30 controls the condenser fan capacity; and signals 32, 34 and 36 control the operation of valves 52, 54 and 56 respectively.

For normal cooling and dehumidifying operation with reheat coil 24 inactive, valve 52 is open, and valves 54 and 56 are closed. Refrigerant discharged from compressor system 14 flows in series through condenser 20 to condense therein, through a check valve 58, through an expansion valve 60 to cool the refrigerant by expansion, through evaporator 16 to remove heat from supply air 62, and back to the suction side of compressor system 14. Evaporator fan system 18 forces supply air 62 across evaporator 16, across reheat coil 24, whereby the conditioned supply air 62 helps improve or maintain the comfort in zone 12.

To achieve dehumidification with little or no cooling of comfort zone 12, i.e., reheat operation, valve 52 can be closed and valve 54 opened, or the two valves 52 and 54 can be modulated to direct all or some of the refrigerant discharged from compressor system 14 to reheat coil 24. Valve 54 being open conveys generally hot, pressurized refrigerant from compressor system 14 to reheat coil 24. The refrigerant condenses in reheat coil 24, thereby heating the supply air 62 previously cooled and dehumidified by evaporator 16. Thus, supply air 62 delivered to zone 12 is dehumidified but warmer than if reheat coil 24 were deactivated.

When reheat coil 24 is deactivated and perhaps flooded or partially flooded with liquid refrigerant, valve 56 can be opened to convey the accumulated liquid refrigerant in reheat coil 24 to evaporator 16 for use in the remaining active portions of refrigerant system 10.

To keep the indoor air of comfort zone 12 within a desired temperature/humidity comfort range, system 10 can be controlled in any conventional way well known to those of ordinary skill in the art. A novel aspect of the invention, however, is how controller 38 minimizes the overall electrical power consumption of system 10 while comfort zone 12 is within a predetermined target comfort range 64, shown in FIG. 2.

Figure 2:
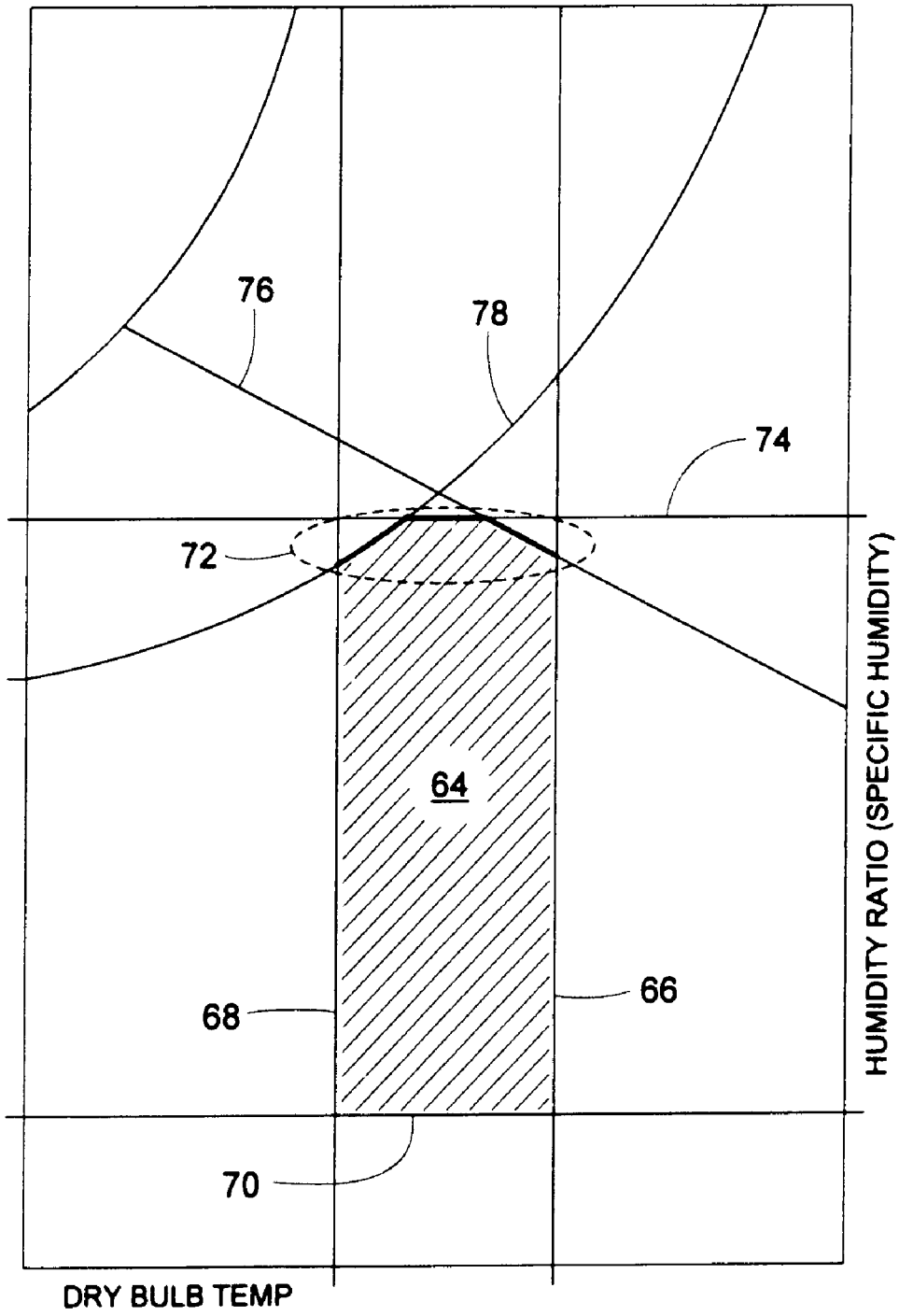
FIG. 2 is a psychrometric chart illustrating a target comfort range.

Comfort range 64 can be defined in various ways and may change from one season to another. For sake of example, comfort range 64 of FIG. 2 is defined by a maximum indoor air temperature 66 (e.g., 75° F. dry bulb temperature), a minimum indoor air temperature 68 (e.g., 70° F. dry bulb temperature), a minimum indoor humidity limit 70 (e.g., dew point of 40° F. as indicated by line 70), and a maximum indoor humidity limit 72 (e.g., a humidity ratio of 10 lbs of water vapor per 1,000 lbs of dry air as indicated by line 74, a wet bulb temperature limit of 66° F. as indicated by line 76, and/or a relative humidity limit of 60% as indicated by line 78).

Figure 3:
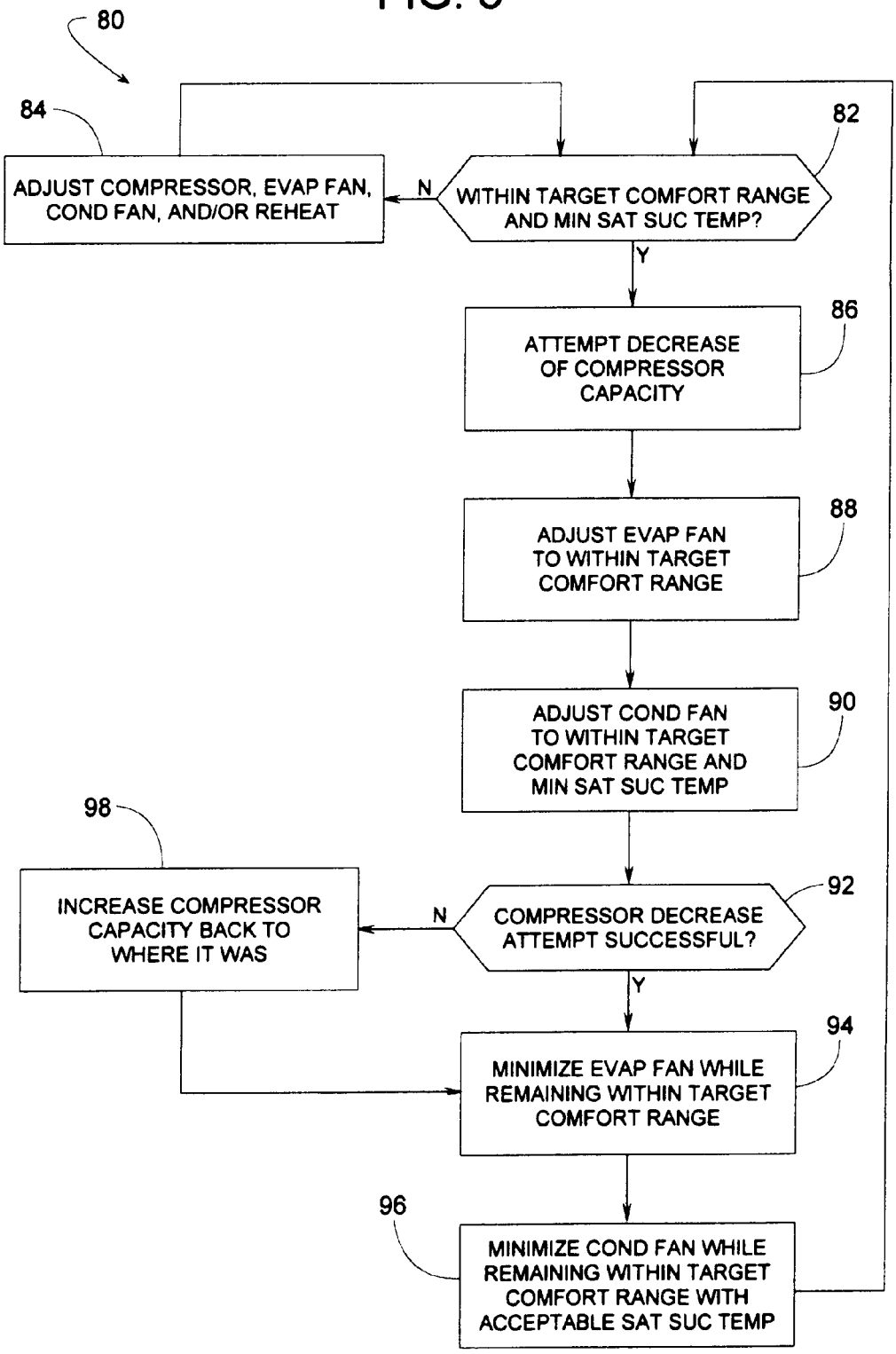
FIG. 3 is a control algorithm.

To minimize the power consumption of system 10 while keeping zone 12 within the predetermined target comfort range 64, controller 38 can function according to a novel algorithm 80, which is stored in a memory 83 of controller 38 and illustrated in FIG. 3. In block 82, controller 38 in response to feedback signals 40, 42 and 44 determines whether zone 12 is within target comfort range 64 and the refrigerant flowing to compressor 14 is above a predetermined minimum temp/press value (e.g., saturated suction temperature is above 30° F.). If the conditions of comfort zone 12 is beyond the target comfort range 68, block 84 commands controller 38 to adjust the compressor capacity, the evaporator fan capacity, condenser fan capacity, and/or reheat operation to bring zone 12 back within comfort range 64. Step 84 can be carried out by any means well known to those of ordinary skill in the art.

If, however, zone 12 is within comfort range 64 and the refrigerant flowing to compressor system 14 is above a predetermined minimum temp/press value, then controller 38 periodically attempts to decrease the compressor capacity as indicated by control block 86.

After decreasing the compressor capacity (e.g., by deactivating one of the four compressors), controller 38 per block 88 tries to keep zone 12 within the target comfort range 64 by adjusting the evaporator fan capacity (e.g., increasing the evaporator fan capacity). In block 90, controller 38 also adjusts the condenser fan capacity. Controller 38, for example, might increase the condenser fan capacity to maintain zone 12 within comfort range 64, or controller 38 might decrease the condenser fan capacity to ensure at least a minimum saturated suction temperature of the refrigerant leaving evaporator 16.

Block 92 determines whether controller 38 was successful in the attempt to decrease compressor capacity while maintaining zone 12 within comfort range 64 with the refrigerant flowing to compressor system 14 above the minimum saturated suction temperature. If the attempt was successful, block 94 directs controller 38 to minimize the evaporator fan capacity without exceeding target comfort range 64. Next, to further reduce power consumption, block 96 directs controller 38 to minimize the condenser fan capacity without exceeding target comfort range 64 and without causing the saturated suction temperature to drop below the predetermined minimum temp/press value. Following a certain time delay after block 96, control returns to block 82.

However, if in block 92 it is determined that the attempt to decrease the compressor capacity failed (e.g., the indoor air of zone 12 exceeded the target comfort range), then control shifts from block 92 to block 98, and controller 38 returns the compressor capacity to where it was just prior to block 86.

Although the invention is described with respect to a preferred embodiment, modifications thereto will be apparent to those of ordinary skill in the art. The scope of the invention, therefore, is to be determined by reference to the following claims:

The invention claimed is:

1. A method of adjusting an overall electrical power consumption a refrigerant system that circulates a refrigerant to maintain the indoor air of a comfort zone within a target comfort range, wherein the refrigerant system includes a compressor system having a compressor capacity that is variable in terms of mass flow rate of refrigerant flowing to the compressor system, a condenser fan system having a condenser fan capacity that is variable in terms of airflow volume, and an evaporator fan system having an evaporator fan capacity that is variable in terms of airflow volume, the method comprising:

adjusting the compressor capacity;

adjusting the evaporator fan capacity;

adjusting the condenser fan capacity such that the steps of adjusting the compressor capacity, adjusting the evaporator fan capacity, and adjusting the condenser fan capacity minimizes the overall electrical power consumption of the refrigerant system while maintaining the indoor air of the comfort zone within the target comfort range and keeping the refrigerant flowing to the compressor system at a temp/press value that is above a predetermined minimum temp/press value;

periodically reducing the compressor capacity from a first capacity to a reduced capacity, adjusting at least one of the evaporator fan capacity and condenser fan capacity as an attempt to maintain the indoor air within the target comfort range while the refrigerant flowing to the compressor system is above the predetermined minimum temp/press value;

if the attempt succeeds, reducing the evaporator fan capacity to a minimum level at which the refrigerant system can still maintain the indoor air within the target comfort range while the compressor capacity is at the reduced capacity and the temp/press value is above the predetermined minimum temp/press value; and if the attempt fails, returning the compressor capacity to the first capacity and adjusting the evaporator fan capacity to the minimum level at which the refrigerant system can still maintain the indoor air within the target comfort range while the compressor capacity is at the first capacity and the refrigerant flowing to the compressor system is above the predetermined minimum temp/press value.

2. The method of claim 1, further comprising increasing the evaporator fan capacity prior to increasing the compressor capacity in response to the indoor air moving away from the target comfort range.

3. The method of claim 1, further comprising increasing the condenser fan capacity prior to increasing the evaporator fan capacity in response to the indoor air moving away from the target comfort range.

4. A method of operating a refrigerant system that circulates a refrigerant to maintain the indoor air of a comfort zone within a target comfort range, wherein the refrigerant system includes a compressor system having a compressor capacity that is variable in terms of refrigerant mass flow rate, a condenser fan system having a condenser fan capacity that is variable in terms of airflow volume, and an evaporator fan system having an evaporator fan capacity that is variable in terms of airflow volume, the method comprising:

operating the compressor system at a first capacity;

reducing the compressor capacity from the first capacity to a reduced capacity;

upon reducing the compressor capacity to the reduced capacity, adjusting at least one of the evaporator fan capacity and condenser fan capacity as an attempt to maintain the indoor air within the target comfort range while the refrigerant flowing to the compressor system is above a predetermined minimum temp/press value;

if the attempt succeeds, reducing the evaporator fan capacity to a minimum level at which the refrigerant system can still maintain the indoor air within the target comfort range while the compressor capacity is at the reduced capacity and a temp/press value of the refrigerant flowing to the compressor system is above the predetermined minimum temp/press value; and if the attempt fails, returning the compressor capacity to the first capacity and adjusting the evaporator fan capacity to the minimum level at which the refrigerant system can still maintain the indoor air within the target comfort range while the compressor capacity is at the first capacity and the refrigerant flowing to the compressor system is above the predetermined minimum temp/press value.

5. The method of claim 4, further comprising periodically minimizing the condenser fan capacity to where the refrigerant system can still maintain the indoor air within the target comfort range and the temp/press value above the predetermined minimum temp/press value.

6. The method of claim 4, wherein the target comfort range is defined by a maximum indoor air temperature, a minimum indoor air temperature, a maximum indoor humidity limit and a minimum indoor humidity limit.

7. The method of claim 4, wherein the temp/press value is a saturated suction temperature of the refrigerant flowing to the compressor system.

8. The method of claim 4, wherein the compressor system includes a plurality of compressors, the evaporator fan system includes a variable speed fan, and the condenser fan system includes a plurality of fans.

9. The method of claim 4, further comprising increasing the evaporator fan capacity prior to increasing the compressor capacity in response to the indoor air moving away from the target comfort range.

10. The method of claim 4, further comprising increasing the condenser fan capacity prior to increasing the evaporator fan capacity in response to the indoor air moving away from the target comfort range.

11. A refrigerant system circulating a refrigerant to control a condition of indoor air of a comfort zone in a building, the refrigerant system comprising:

a condenser for condensing the refrigerant;

an evaporator for vaporizing the refrigerant;

a compressor system having a compressor capacity that is variable in terms of refrigerant mass flow rate;

a condenser fan system connected to force air across the condenser, wherein the condenser fan system has a condenser fan capacity that is variable in terms of airflow volume;

an evaporator fan system connected to force air across the evaporator, wherein the evaporator fan system has an evaporator fan capacity that is variable in terms of airflow volume;

an indoor air temperature sensor sensing an indoor air temperature of the comfort zone and providing an indoor air temperature signal that varies with the indoor air temperature;

a humidity sensor sensing a humidity characteristic of the comfort zone and providing a humidity signal that varies with the humidity characteristic;

a suction refrigerant sensor sensing a temp/press value of the refrigerant flowing to the compressor system and providing a suction refrigerant signal that varies with the temp/press value; and a controller connected to receive the indoor air temperature signal, the humidity signal, and the suction refrigerant signal; the controller includes a memory for storing a target comfort range for the indoor air of the comfort zone and a predetermined minimum temp/press value, wherein the target comfort range is defined by a maximum indoor air temperature, a minimum indoor air temperature, a maximum indoor humidity limit and a minimum indoor humidity limit; the controller is also connected in communication with the refrigerant compressor system, the condenser fan system and the evaporator fan system to vary their capacities as follows:

a) when the compressor system is operating at a first capacity, the controller periodically decreases the compressor capacity to a reduced capacity and adjusts the evaporator fan capacity and the condenser fan capacity to determine if the refrigerant system with the reduced capacity can maintain the indoor air within the target comfort range while the refrigerant flowing to the compressor system is above the predetermined minimum temp/press value;

b) if the refrigerant system with the reduced capacity can maintain the indoor air within the target comfort range while the refrigerant flowing to the compressor system is above the predetermined minimum temp/press value, then the controller reduces the evaporator fan capacity to a minimum level at which the refrigerant system can still maintain the indoor air within the target comfort range while the compressor system is at the reduced capacity and the temp/press value is above the predetermined minimum temp/press value;

c) if the refrigerant system with the reduced capacity cannot maintain the indoor air within the target comfort range while the refrigerant flowing to the compressor system is above the predetermined minimum temp/press value regardless of any adjustment of the evaporator fan capacity and condenser fan capacity, then the controller returns the compressor capacity to the first capacity and reduces the evaporator fan capacity to the minimum level at which the refrigerant system can still maintain the indoor air within the target comfort range while the compressor system is at the first capacity and the refrigerant flowing to the compressor system is above the predetermined minimum temp/press value; and d) when the compressor system is operating, the controller also periodically minimizes the condenser fan capacity to where the refrigerant system can still maintain the indoor air within the target comfort range and the temp/press value above the predetermined minimum temp/press value.

12. The refrigerant system of claim 11, further comprising a reheat coil for releasing heat, wherein evaporator system is further connected to force air across the reheat coil.

13. The refrigerant system of claim 11, wherein the temp/press value is a saturated suction temperature of the refrigerant flowing from the evaporator to the compressor system.

14. The refrigerant system of claim 11, wherein the compressor system includes a plurality of compressors, the evaporator fan system includes a variable speed fan, and the condenser fan system includes a plurality of fans.

15. The refrigerant system of claim 11, wherein the controller increases the evaporator fan capacity prior to increasing the compressor capacity in response to the indoor air moving away from the target comfort range.

16. The refrigerant system of claim 11, wherein the controller increases the condenser fan capacity prior to increasing the evaporator fan capacity in response to the indoor air moving away from the target comfort range.

17. The refrigerant system of claim 11, wherein the maximum indoor humidity limit is a predetermined maximum wet bulb saturation temperature of the indoor air.

18. The refrigerant system of claim 11, wherein the maximum indoor humidity limit is a predetermined maximum specific humidity value of the indoor air.

19. The refrigerant system of claim 11, wherein the maximum indoor humidity limit is a predetermined maximum relative humidity value of the indoor air.

20. The refrigerant system of claim 11, wherein the minimum indoor humidity limit is a predetermined minimum wet bulb saturation temperature of the indoor air.

21. The refrigerant system of claim 11, wherein the minimum indoor humidity limit is a predetermined minimum specific humidity value of the indoor air.

22. The refrigerant system of claim 11, wherein the minimum indoor humidity limit is a predetermined minimum relative humidity value of the indoor air.

23. A method of adjusting an overall electrical power consumption a refrigerant system that circulates a refrigerant to maintain the indoor air of a comfort zone within a target comfort range, wherein the refrigerant system includes a compressor system having a compressor capacity that is variable in terms of mass flow rate of refrigerant flowing to the compressor system, a condenser fan system having a condenser fan capacity that is variable in terms of airflow volume, and an evaporator fan system having an evaporator fan capacity that is variable in terms of airflow volume, the method comprising:

adjusting the compressor capacity;

adjusting the evaporator fan capacity;

adjusting the condenser fan capacity such that the steps of adjusting the compressor capacity, adjusting the evaporator fan capacity, and adjusting the condenser fan capacity minimizes the overall electrical power consumption of the refrigerant system while maintaining the indoor air of the comfort zone within the target comfort range and keeping the refrigerant flowing to the compressor system at a temp/press value that is above a predetermined minimum temp/press value; and periodically minimizing the condenser fan capacity to where the refrigerant system can still maintain the indoor air within the target comfort range and the temp/press value above the predetermined minimum temp/press value.

* * * * *